United States Patent [19]

Silvis et al.

[11] 3,974,541

[45] Aug. 17, 1976

[54] APPARATUS FOR CLEANING A FLOOR COVER

[76] Inventors: Donahue B. Silvis, 304 Lake View; Edward A. Vargas, 3921 Duke Road, both of Lake Orion, Mich. 48053

[22] Filed: Nov. 1, 1973

[21] Appl. No.: 411,636

[52] U.S. Cl. ..... 15/320; 15/300 A; 15/314; 15/322

[51] Int. Cl.[2] ..... A47L 13/26

[58] Field of Search ..... 15/320, 321, 322, 300 A, 15/331, 314

[56] References Cited

UNITED STATES PATENTS

| | | | |
|---|---|---|---|
| 1,801,135 | 4/1931 | Blogg | 15/320 |
| 1,803,693 | 5/1931 | Cutting | 15/320 |
| 2,481,760 | 9/1949 | Leher | 15/321 X |
| 2,622,254 | 12/1952 | Mendelson | 15/320 X |
| 3,258,809 | 7/1966 | Harvey | 15/321 |
| 3,619,849 | 11/1971 | Jones | 15/322 X |
| 3,663,985 | 5/1972 | Burgoon | 15/320 X |
| 3,683,447 | 8/1972 | Stevenson | 15/300 A X |
| 3,828,390 | 8/1974 | Cater | 15/321 |

*Primary Examiner*—Billy J. Wilhite
*Assistant Examiner*—James A. Niegowski
*Attorney, Agent, or Firm*—Gifford, Chandler & Sheridan

[57] ABSTRACT

A self-contained portable apparatus for cleaning a floor cover, such as a carpet. The apparatus comprises vacuum chambers; electric motor driven vacuum creating mechanisms; vacuum nozzles operatively associated with the vacuum chambers; a spray bar and nozzles operatively connected with a source of water; a source of emulsifying agent; a siphon device for extracting emulsifying agent from its source and introducing it into the water flowing to the spray nozzles; a heating element for heating the water as it flows to the spray bar; and appropriate valving and plumbing; all of which are included within a single housing. In addition, the housing includes a roller so that the apparatus may be easily rolled over the floor cover to be cleaned. There is also included a hand tool operatively connected with one of the vacuum chambers of the apparatus for cleaning the floor in hard to get at places too small or inconvenient to reach with the self-contained floor cover cleaning apparatus.

9 Claims, 9 Drawing Figures

APPARATUS FOR CLEANING A FLOOR COVER

BACKGROUND OF THE INVENTION

I. Field of the Invention

The present invention relates to portable cleaning equipment, and more particularly to devices for cleaning floor covers, such as carpets.

II. Description of the Prior Art

The most usual and efficeint method of cleaning floor covers, particularly carpets, is to use water in conjunction with a cleaning agent, as opposed to using a dry cleaning agent. However, there are a number of problems inherent with the use of water when cleaning carpets. For example, if the water and cleaning agent are allowed to remain in the cleaned carpet for a period of time, there exists the risk of shrinkage, discoloration, mildew, and, depending upon the fabric of the carpet and the cleaning agent used, the further risk of chemical burns and color fading.

There are two basic types of known devices which use water and a cleaning agent for cleaning carpets. These devices are the scrubbing type devices which use scrub brushes and soap in solution with water, and the so-called "steam cleaner" type devices which in reality spray hot water under pressure and an emulsifying agent, not steam, on the carpet to be cleaned.

The known scrubbing type devices deposit soap and water onto the carpet and scrub brushes work the soap and water into the carpet fibers. These devices do not extract the water and soap from the carpet fibers, and not only subject the carpet fibers to the type of damage mentioned above, but, in addition, leave an oil film from the soap in the carpet hastening the resoiling of the carpet. Further, additional damage is caused to the carpet by the rubbing action of the scrub brush.

While the known "steam cleaning" or hot water spray cleaning devices do not utilize scrub brushes and a soap solution, thus eliminating some of the drawbacks of the above discussed scrubbing type devices, they do have a number of serious drawbacks. These devices do attempt to remove the water and cleaning agent used in cleaning from the carpet. However, due to their construction, they are unable to remove enough of the water and cleaning agent to leave the carpet essentially dry. Further practical problems with the "steam cleaning" devices are their extreme weight and bulk. This weight and bulk has a number of practical ramifications, only one of them being the expense of manufacture. Because of the extreme weight and bulk, and therefore expense, of these known hot water spray cleaning devices, they find their main use in commercial carpet cleaning businesses. Because these devices are so bulky and heavy, they must be transported from one job site to another job site by a truck, and require at least a crew of two men to load and unload them from the truck. In addition, they are comprised of a number of separate units, such as a holding tank for the water to be used in cleaning the carpet, which tank includes a heating device to heat the water and a pressurizing device to pressurize the water; a separate vacuum creating device to create a vacuum for extracting the water and cleaning solution from the carpet; a separate hand piece operatively associated with both the hot water tank and the vacuum creating means by external plumbing; and a separate holding tank operatively associated with the hand piece for holding the dirty water and cleaning solution extracted from the carpet by the hand piece, which holding tank must be manually emptied from time to time as it becomes full. In addition to being extremely heavy, all these separate components require a substantial amount of set-up time and break-down time, which time is commercially non-productive and therefore expensive.

SUMMARY OF THE INVENTION

The present invention is a lightweight, inexpensive, self-contained floor cover cleaning apparatus of the type commonly referred to as "steam cleaning" devices, but which actually use hot water under pressure and an emulsifying agent which is particularly well suited for cleaning carpets and rugs. The apparatus comprises a housing which encloses a spray bar having nozzles for spraying hot water and emulsifying agent onto the surface to be cleaned; two vacuum chambers; vacuum creating means operatively associated with the vacuum chambers; two tandem juxtaposed vacuum nozzles opeatively connected to the vacuum chambers for immediately extracting the water, dirt and emulsifying agent from the floor cover and depositing it in the vacuum chambers; a heating element which selectively heats the water as it flows to the spray bar from a source of water; a siphoning device which utilizes the hot water flow from the source of water to the spray nozzles to create a siphonage which extracts a measured amount of an emulsifying agent from a small storage vessel mounted in the cleaning apparatus and automatically introduces it into the hot water flowing to the spray bar at a controlled rate; and a pump for continuously emptying the extracted water, dirt and emulsifying agent from the vacuum chambers.

The apparatus of the present invention also includes a hand tool which is selectively operatively connected to the vacuum chambers for use in reaching hard to get at places which may be inaccessible to the self-contained apparatus.

The apparatus of the present invention obviates all of the above mentioned drawbacks associated with the heretofore known scrubbing type floor cover cleaning devices because it does not use scrub brushes, not a soap solution, and it extracts the water solution and dirt from the floor cover.

The apparatus of the present invention also is a vast improvement over the heretofore known "steam cleaning" or hot water spray floor cover cleaning devices. The present cleaning apparatus is compact, lightweight and self-contained. These attributes virtually eliminate set-up and break-down time, making the device more efficient than the prior known devices. Furthermore, these same characteristics allow the cleaning apparatus of the present invention to be easily transported from one work site to another in the trunk of a small car and requires only one man to load and unload it from the car and to operate it. The light weight and compactness of the present apparatus also now makes "steam cleaning" practical by individuals, such as homeowners, as well as commercial floor cover cleaning businesses.

The apparatus of the present invention utilizes hot water supplied directly from a water supply, such as a conventional faucet, in the building wherein the floor cover to be cleaned is located. The water is used at the pressure at which it is supplied at the tap or faucet, which is usually on the order of 40 psi. Thus, there is no need for a separate container to heat and pressurize the water before it is used. Furthermore, the dirty water extracted from the carpet during the cleaning operation is pumped directly to any convenient waste water depository in the building, such as a sanitary bowl, sink or floor drain, thus eliminating the need for a waste water holding tank.

Further, the unique tandem positioning of two vacuum nozzles results in extraction of substantially all of the water from the carpet being cleaned.

The apparatus of the present invention is also more economical to operate than the heretofore known "steam cleaning" devices. The siphoning device of the present apparatus provides a metered flow of emulsifying agent which cannot be varied by the operator of the apparatus. This assures that only the proper amount of emulsifying agent is used to clean the carpet, thus eliminating waste, but, in addition, provides a means of accounting for the amount of emulsifying agent used in a given time period, which is of substantial benefit to a commercial firm. Further, the heating element is selectively operated only when a particularly soiled area must be cleaned and is used only to further increase, by a relatively small amount, the temperature of the already hot water as it flows to the spray bar. This means that water is selectively heated only as it is being used, thus saving energy.

BRIEF DESCRIPTION OF THE DRAWINGS

The description herein makes reference to the accompanying drawings wherein like numerals refer to like parts throughout the several views, and in which.

DETAILED DESCRIPTION OF THE PREFERRED EMBODIMENT

Figure 1:
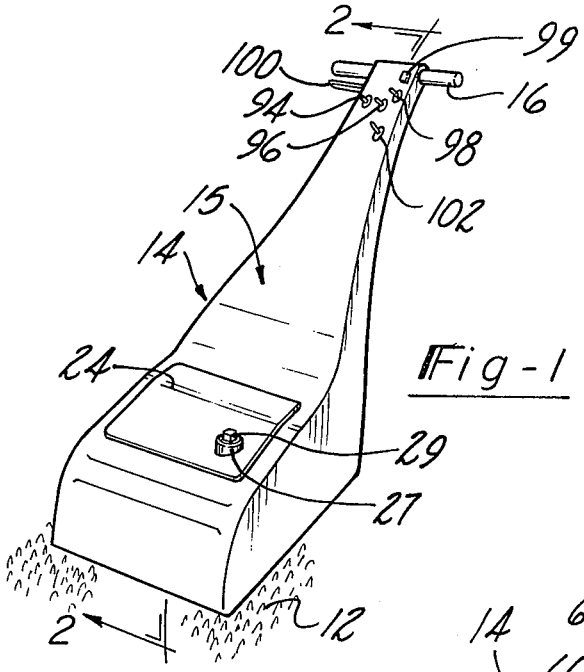
FIG. 1 is a perspective view of the preferred embodiment of a floor cover cleaning apparatus.
Figure 2:
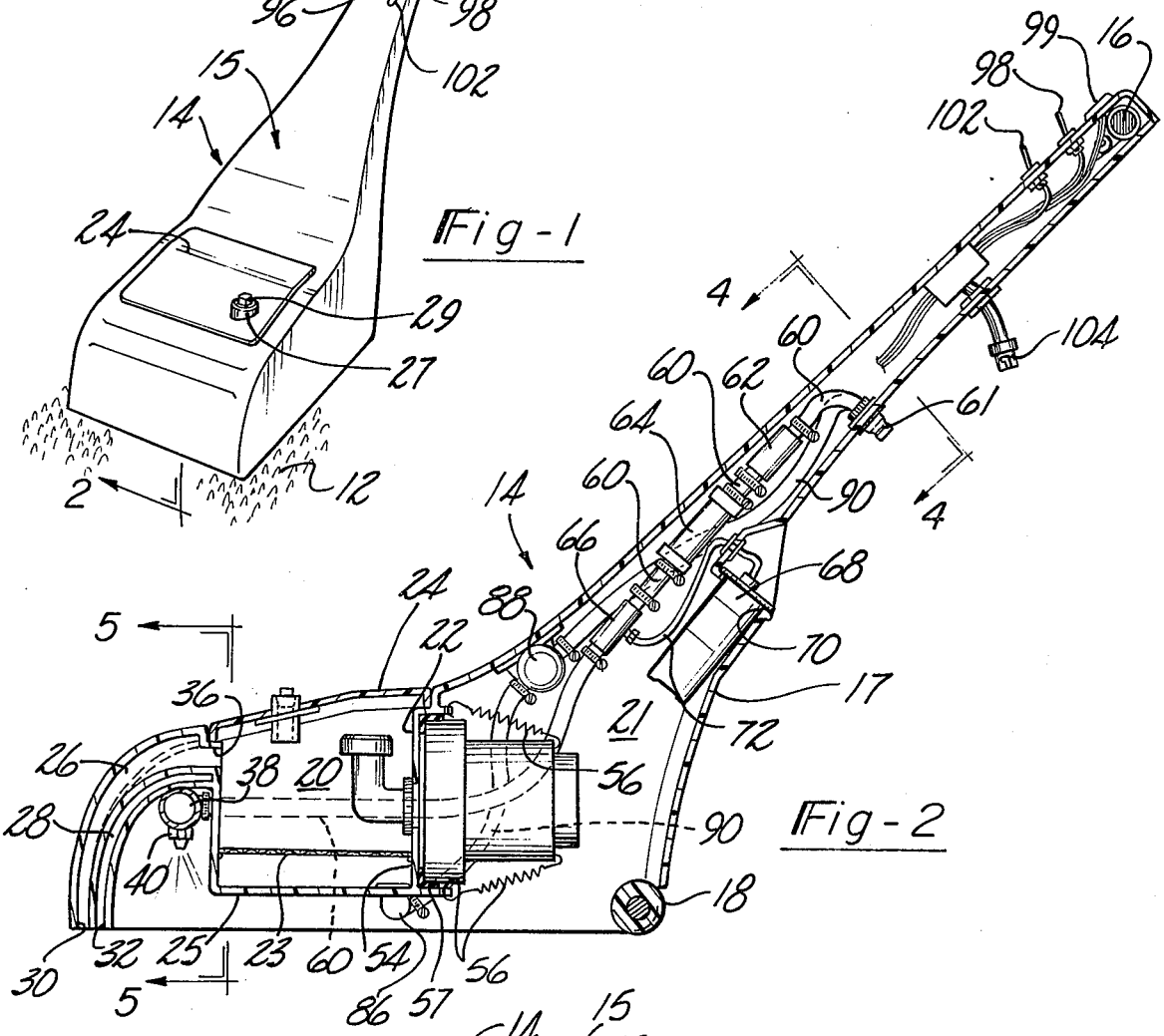
FIG. 2 is a sectional view taken along line 2—2 of FIG. 1.
Figure 3:
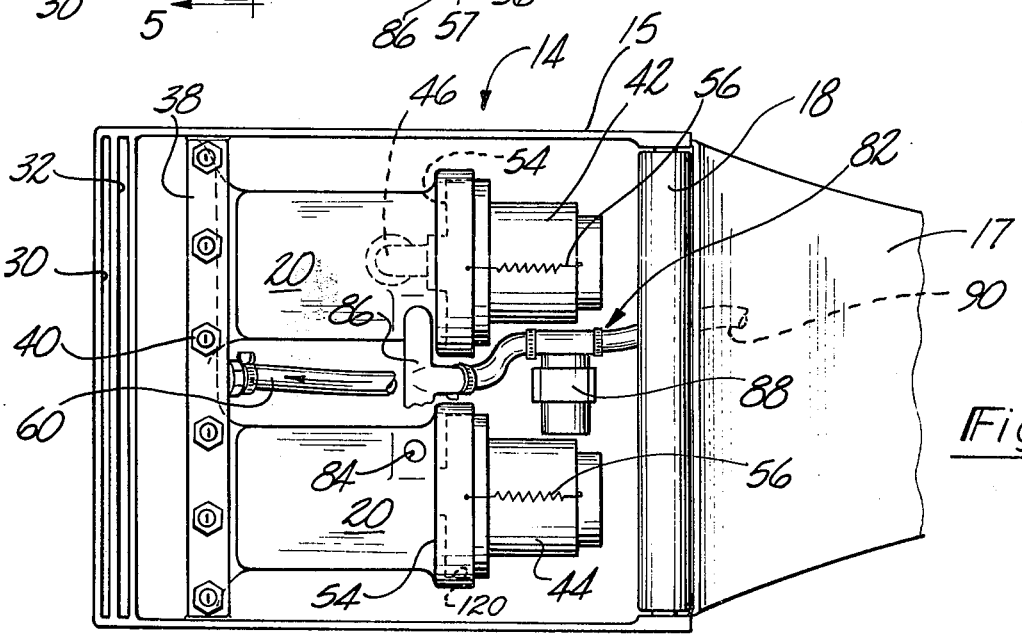
FIG. 3 is a partially fragmented bottom view of the apparatus of the present invention.

FIGS. 1–3 show a self-contained floor cover cleaning apparatus 10 which is particularly well suited for cleaning a carpet 12. The cleaning apparatus 10 is of the so-called "steam cleaning" type, which in reality sprays an emulsifying agent and hot water solution onto the carpet 12 and subsequently extracts it by vacuum action.

The cleaning apparatus 10 comprises a housing 14 with an operator's handle 16 disposed at one end and a roller 18 rotatably mounted thereto so that the cleaning apparatus 10 is easily moved over the carpet 12 to be cleaned. The housing 14 includes a top portion 15 and a back portion 17 which are fastened together by means of standard fasteners, such as screws 19 (see FIG. 4), forming a hollow interior 21 therebetween. The housing 14 could be made of almost any material, however, it has been found in practice that a fiberglass material works well and is preferred for its lightness and strength.

Referring to FIGS. 1–3 and 5, two vacuum chambers 20 are disposed in side-by-side relationship within the housing 14 and, as shown, may be integrally formed with the tip portion 15 of the housing. Each of the chambers 20 includes an access opening 22 providing access into the chambers 20 from the top of the apparatus 10, and a screen 23 spaced upwardly from a floor 25 of the chamber. A cover 24 selectively and sealably closes the openings 22 into the chambers 20. It should be obvious, however, that two covers could be substituted for the cover 24, each closing the opening 22 into a different one of the chambers 20.

Figure 5:
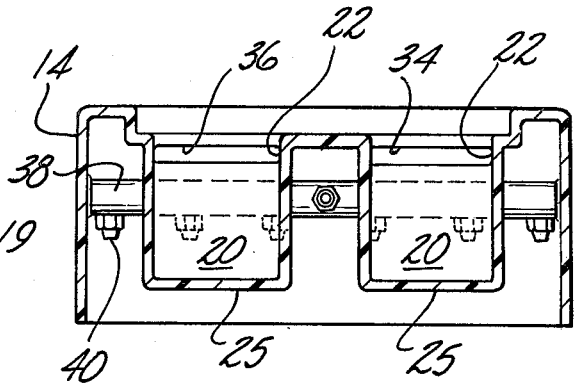
FIG. 5 is a view taken along line 5—5 of FIG. 2.

Two vacuum nozzles 26 and 28 are disposed within the housing 14. Each of the nozzles 26 and 28 have elongated openings 30 and 32, respectively, disposed at the front of the apparatus 10 extending transversely across the width of the apparatus 10 and disposed in juxtaposed tandem relationship to each other. The openings 30 and 32 are located at the bottom of the apparatus 10 so that they will be in juxtaposition to the carpet 12 during the cleaning operation. Further, the vacuum nozzles 26 and 28 are each operatively associated with a different one of the vacuum chambers 20 by means of apertures 34 and 36, respectively (FIGS. 2 and 5). Preferably the vacuum nozzles 26 and 28 are integral with the housing 14.

A vacuum fitting 27 comprising a hollow cylindrical tube extends through the cover 24 so that one of its ends is interior to one of the vacuum chambers 20 and the other of its ends opens to the exterior. A sealing cap 29 selectively closes the opening into the exterior (see FIG. 2). The function of the fitting 27 will be explained hereinbelow.

Water spraying means, such as an elongated hollow spray bar 38, is transversely disposed across the width of the housing 14 between the vacuum chambers 20 and the juxtaposed tandem vacuum nozzles 26, 28. The elongated spray bar 38 is substantially parallel to the openings 30, 32 of the vacuum nozzles 26, 28. A series of six water spray nozzles 40 are disposed along the longitudinal axis of the spray bar 38 so as to direct a water spray downwardly toward the carpet 12 to be cleaned. In practice, it has been determined that an efficient cleaning job is performed with a volume rate of flow at 1.2 gallons per minute.

Vacuum creating means, such as two electric motor driven squirrel cage fans 42 and 44, are each operatively associated with a different one of the vacuum chambers 20 by means of air ducts 46 which project into different vacuum chambers 20. Each air duct 46 has one open end 50 interior to the chamber and another end communicating with the squirrel cage fan 42, 44. A filter screen is disposed over the open end of the air duct to prevent foreign matter from entering the fan 42, 44.

Each of the electric motor driven fans 42, 44 is mounted directly to the back wall 54 of a different one of the vacuum chambers 20 by two springs 56 which bias the motor driven fan against the back wall 54 and retain it in position. Each of the motor driven fans fit within a pocket 120 formed in the back wall 54 which positively locates it against the wall. An O-ring type seal 57 is disposed between the motor driven fan and the back wall 54 to prevent air from leaking therebetween.

The spray bar 38 is operatively connected to a source of water by means of a water carrying conduit 60. The conduit 60 includes a conventional quick disconnect fitting 61 at one of its ends. A hose (not shown) having a mating disconnect fitting at one of its ends is connected to the fitting 61 and to a source of hot water. The source of water may be, for example, any convenient water tap or faucet (not shown) which is located in the building wherein the carpet 12 to be cleaned is located.

Disposed in the water carrying conduit 60, preferably in sequence from the source of water to the spray bar 38, are a water heater 62, a solenoid actuated on-off valve 64 and a cleaning agent introducing means 66.

Figure 9:
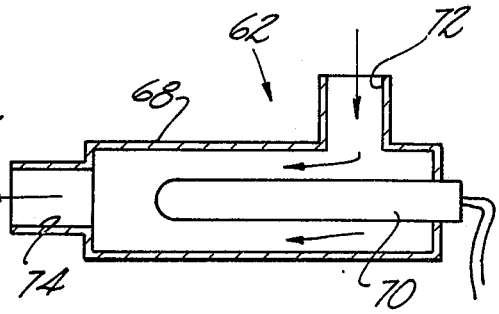
FIG. 9 is a sectional view of a heating device used in the floor cover cleaning apparatus.

The water heater 62 comprises a hollow container 68 housing an electrical resistance element 70 (see FIGS. 2 and 9). The container has an inlet port 72 and an outlet port 74 each communicating with the conduit 60 such that the electrical resistance element 70 is disposed within the flow of water through the container 68. The flow of water through the heater 62 is indicated by the flow arrows in FIG. 9. The purpose of the heater is to selectively further heat the already hot water flowing in the conduit 60 from the source by approximately 10° to 15°. It is selectively placed into operation in the event that a particularly soiled area is encountered or the water from the source is not otherwise hot enough for adequate cleaning of the carpet 12.

Figure 6:
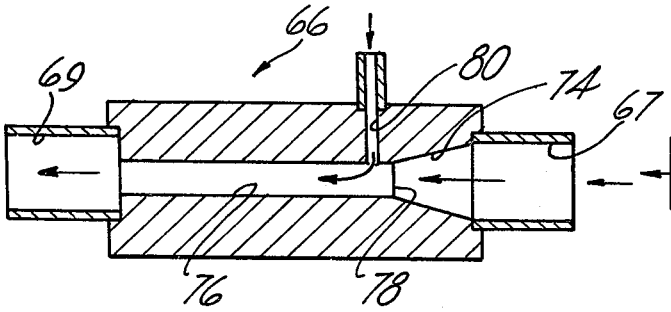
FIG. 6 is a sectional view of a siphoning device used in the floor cover cleaning apparatus.

The container 68 of cleaning or emulsifying agent is housed in a cavity 70 located in the back portion 17 of the housing 14. A fluid carrying conduit 72 connected at one end to the emulsifier agent introducing means 66 at the other end to the container 68 provides a means of fluid communication therebetween. The emulsifier agent introducing means 66 (see FIGS. 2 and 6) creates a siphonage by the action of the water flowing through it, thus causing the emulsifying agent to flow from its container through the conduit 72 to the introducing means 66, whereat it is injected into the hot water flowing in the supply conduit 60 to the spray bar 38.

The cleaning or emulsifying agent introducing means 66 comprises an inlet port 67, an outlet port 69, a convergent nozzle 74, a first aperture 76 providing a means of fluid communication between the throat 78 and the outlet port 69, and a second aperture 80 providing a means of fluid communication between the one end of the fluid carrying conduit 72 and the first aperture 76. The supply conduit 60 fluidly communicates with the inlet port 67 and outlet port 69. The water in the supply conduit 60 flows into the convergent nozzle through the inlet port 67 and continues through the throat 78, whereat the water flow is accelerated resulting in a decrease in water pressure downstream of the throat 78 and causing a siphonage at the juncture of the first and second apertures 78 and 80. This siphonage causes the emulsifying agent to flow from its container 68 and through the conduit 72, hence through the second aperture 80 and into the first aperture 78 where it is mixed with the hot water flowing from the inlet port 67 to the outlet port 69, as indicated by the flow arrows in FIG. 6.

Figure 4:
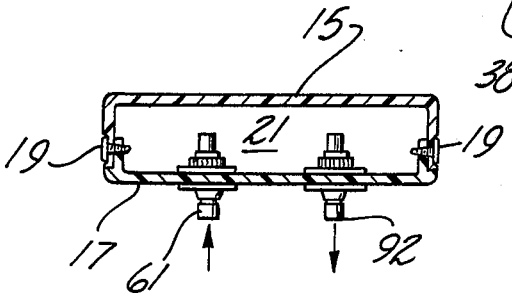
FIG. 4 is a view taken along line 4—4 of FIG. 2.

Referring to FIGS. 2, 3 and 4, fluid removing means 82 are operatively associated with the vacuum chambers 20 to continuously empty water from the chambers as it is removed from the carpet 12 by the vacuum nozzles 26, 28 and deposited in the chambers. The fluid removing means 82 comprises a drain port 84 through the floor 25 of each chamber 20, a T-fitting 86 having each of its branches communicating with a different drain port 84, and an electric pump 88 communicating with the stem of the T-fitting 86. A waste water conduit 90 communicates at one of its ends with the pump and has a conventional quick disconnect fitting 92 at its opposite end for attachment to a hose (not shown) which leads to any convenient depository, such as a sink or floor drain, for the waste water pumped from the vacuum chambers 20 by the pump 88.

Each of the electric motor driven vacuum creating fans 42 and 44 are connected to a source of electrical energy through on-off switches 94 and 96, respectively (see FIGS. 1 and 2), so that they can be turned on and off individually. The heater 62 is electrically connected to a switch 98 for enabling the operation of the heater circuit and to a power switch 100 for connecting the source of electrical power to the heater circuit. A warning light 99 is connected to the heater circuit to illuminate when the switch 98 is in the "on" position. The pump 88 is electrically connected to a switch 102 for enabling the operation of the pump circuit and to the power switch 100 for connecting the source of electrical power to the pump circuit. The solenoid operated valve 64 is electrically connected to the power switch 100. All of the electric circuits are connected to the source of electrical power, such as a 120 volt, 30 amp source of alternating current found in most buildings, by means of conventional quick disconnect fitting 104.

In operation, the operator first turns on the vacuum fans 42, 44 by actuating the switches 94 and 96. Next, power is supplied to the circuit of the pump 88 by actuating the switch 102. The operator then grasps the handles 16 and actuates the power switch 100. Upon actuation of the power switch 100, the pump 88 is turned on, and the solenoid operated valve 64 is opened allowing hot water to flow from the source of water through the water carrying conduit 60, and thus through the emulsifying agent introducing means 66 to the spray bar 38 and out through the water spray nozzles 40 which direct the water and emulsifying agent onto the carpet 12 to be cleaned. Simultaneously, the operator pulls the cleaning apparatus 10 toward him over the carpet 12. As the apparatus 10 moves, the openings 30, 32 of the vacuum nozzles 26, 28, respectively, move over the area of the carpet 12 which has been sprayed with the emulsifying agent and water solution, and by the vacuum created by the vacuum creating fans 42, 44 extracts the emulsifying agent and water solution and dirt from the carpet 12. The vacuum nozzles 26, 28 direct the emulsifying agent and water solution and dirt through the apertures 34, 36 and into the vacuum chambers 20. The filter screens 23 in the chambers 20 separate at least the larger particles of dirt from the emulsifying agent and water solution. The emulsifying agent and water solution then passes through the drain ports 84 and into the T-fitting 86 to the pump 88 which pumps the now dirty emulsifying agent and water solution through the waste water conduit 90 to a convenient depository for waste material.

If a particularly soiled area of carpet is to be cleaned, or if the hot water available from the building's water supply is not adequately hot, the operator turns on the heater 62 by actuating the switch 98. Upon actuation of the power switch 100, power is directed to the heater circuit and the heater is activated. As the water flows through the supply conduit 60, it is heated to the required temperature. When the switch 98 is actuated, the warning light 99 is illuminated to constantly remind the operator that there is electrical energy being supplied to the heater circuit.

The juxtaposed nozzles 26, 28 and dual vacuum creating fans 42, 44 provide a suction action which extracts substantially all of the water and emulsifying agent from the carpet, leaving it essentially dry.

The power switch 100 is of the "dead man" type which automatically returns to the "off" position when released by the operator. Thus, when the operator releases the power switch 100, power is shut-off to the heater circuit and the pump circuit, and the solenoid operated valve causing it to close.

Figure 7:
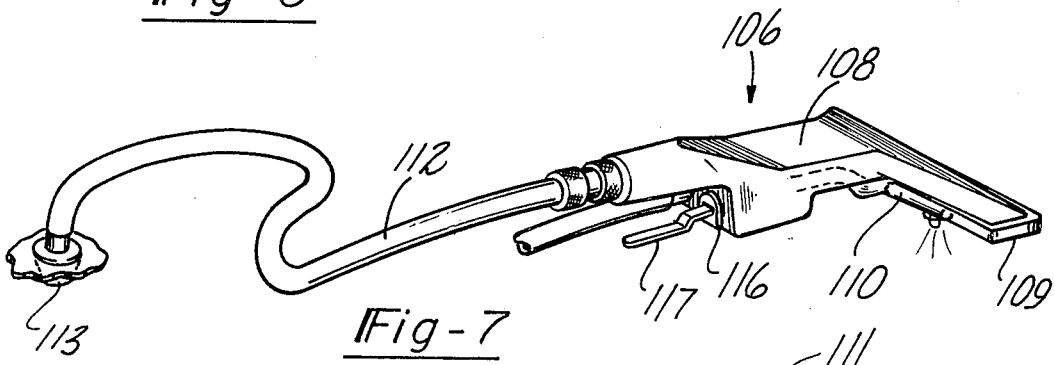
FIG. 7 is a perspective view of a hand tool used in conjunction with the floor cover cleaning apparatus.
Figure 8:
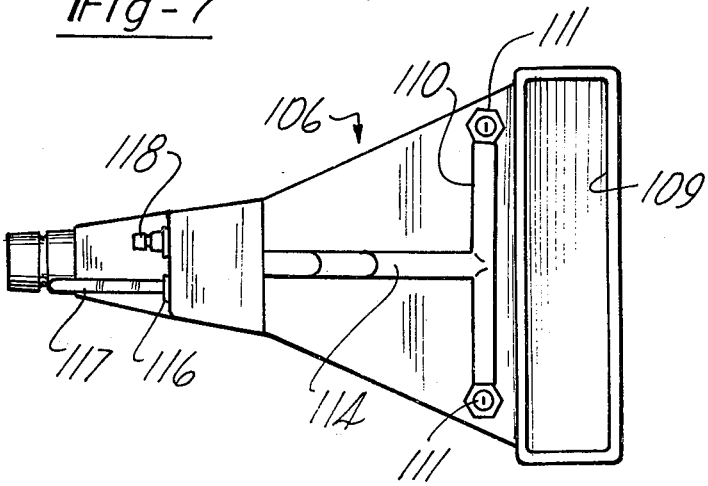
FIG. 8 is a bottom view of the hand tool of FIG. 7.

A hand operated tool 106 (FIGS. 7–8) is used for reaching portions of the carpet 12 which are inaccessible to, or for which it is impractical to use the cleaning apparatus 10, such as carpeted stairs. The hand operated tool 106 comprises a vacuum nozzle 108 having an opening 109 and a water spray bar 110 having two spray nozzles 111 for directing the water toward the carpet to be cleaned. A vacuum line 112 is removably connected at one of its ends to the vacuum nozzle 108 and removably connected at its other end to the vacuum fitting 27 of the cleaning apparatus 10, thus operatively connecting the vacuum nozzle to one of the vacuum chambers 20. The vacuum line 112 is connected to the vacuum fitting 27 by means of a socket 113 which slidably fits over the end of the fitting 27 extending through the vacuum chamber cover 24 to the exterior of the cleaning apparatus 10.

A water conduit 114 is connected at one end to the water spray bar 110 and at its other end to an on-off valve 116 having an actuating handle 117. A water supply line (not shown) from the source of water is removably connected to the on-off valve 116 by means of a conventional quick disconnect fitting 118.

In operation, the water supply line is connected to the source of hot water and to the hand tool 106 by means of the quick disconnect fitting 118, and the vacuum line 112 is connected to one of the vacuum chambers 20 by connecting the socket 113 to the exposed end of the vacuum fitting 27 after removing the cap 29 therefrom. The motor driven vacuum creating fan operatively associated with the vacuum chamber 20 having the vacuum fitting 27 is turned "on", thus creating a vacuum at the opening 109 of the nozzle 108. The hand tool 106 is placed on the carpet 12 to be cleaned so that the opening 109 is adjacent thereto and the spray nozzles 111 are positioned to direct a spray of water onto the carpet. The operator then actuates the on-off valve 116 by depressing the handle 117, which allows hot water to flow from the water supply line through the conduit 114 to the nozzles 111, and hence through the nozzles to the carpet. As the hot water is being sprayed on the carpet, the operator moves the hand tool 106 so that the opening 109 into the vacuum nozzle 108 immediately moves over that portion of the carpet just sprayed with water to extract the water and dirt from the carpet.

It is contemplated that for private use by individuals one of the vacuum creating means 42, 44 may be removed from one of the vacuum chambers 20, and that vacuum chamber used as a storage compartment for extra containers of emulsifying agent.

The foregoing detailed description is given primarily for clarity of understanding and no unnecessary limitations should be understood therefrom for other modifications will be obvious to those skilled in the art upon reading this disclosure and may be made without departing from the spirit of the invention or the scope of the appended claims.

We claim:

1. An apparatus to be moved along a floor for cleaning a floor covering, comprising:

a housing;

a first and a second vacuum chamber disposed within said housing;

a first vacuum nozzle connected with said first vacuum chamber and a second vacuum nozzle connected with said second vacuum chamber;

a first means for creating a vacuum in said first vacuum chamber and hence at said first vacuum nozzle and a second means for creating a vacuum in said second vacuum chamber and hence at said second vacuum nozzle, said means being individually operable and each being disposed within said housing;

means for spraying a fluid on the floor to be cleaned;

means for delivering the fluid to said spraying means;

said first nozzle comprising an elongated opening disposed substantially perpendicular to the path of movement of said apparatus and said second nozzle comprising an elongated opening disposed parallel to said first nozzle and ahead of said first nozzle in the direction of movement of said apparatus;

said spraying means being disposed ahead of said nozzles in the path of movement of said apparatus whereby a portion of said fluid discharged on said floor covering is picked up through said second nozzle and deposited in said second vacuum chamber and whereby the remaining portion of said fluid discharged on said floor covering is thereafter picked up through said first nozzle and deposited in said first vacuum chamber;

means disposed in said housing for removing the fluid from said vacuum chambers;

means for introducing a cleaning agent into said fluid delivery means, said cleaning agent introducing means being disposed within said housing; and valve means to regulate the flow of fluid in said fluid delivery means.

2. The apparatus as defined in claim 1 and including each of said vacuum chambers having a removable sealable cover for closing openings into said chambers.

3. The apparatus as defined in claim 1 and in which said spray means comprises a spray bar having a plurality of spray nozzles disposed at spaced intervals along its length, said elongated spray bar being generally parallel to said openings of said first and second vacuum nozzles.

4. An apparatus as defined in claim 1, further comprising means for continuously heating the fluid as it flows in said fluid delivery means, said heating means being disposed within said housing.

5. An apparatus as defined in claim 4, wherein said heating means comprises:

an enclosure having a fluid inlet aperture and a fluid outlet aperture, each of said apertures being connected to said fluid delivery means;

an electric resistance element disposed within said enclosure to heat the fluid as it passes through said enclosure from said inlet aperture to said outlet aperture;

means for connecting said electric resistance element to a source of electric power; and a switch operatively associated with said electric connecting means for selectively turning said heating means on and off.

6. An apparatus as defined in claim 4, wherein:

said fluid delivery means comprises a conduit having one end connected to said spray bar and the other end removably connectable to a source of fluid;

said cleaning agent introducing means is disposed in said fluid delivery conduit between the ends of said conduit;

said heating means is disposed in said fluid delivery conduit between said cleaning agent introducing means and the end of said conduit removably connectable to the source of fluid;

said fluid removing means comprises:

a pump operatively associated with said first mentioned vacuum chamber and said second vacuum chamber; and a waste conduit having one end connected to said pump and the other end removably connectable to a fluid depository.

7. An apparatus as defined in claim 1, comprising:

a handle connected to said housing to provide a means by which an operator can apply a force to the apparatus to move it over the floor cover to be cleaned; and at least one roller rotatably connected to said housing so that said apparatus can be moved over the floor cover to be cleaned.

8. An apparatus as defined in claim 7, wherein:

said roller is disposed proximate the bottom of said housing and has a rotatable axis disposed substantially perpendicular to the normal direction of movement of said housing as it is being moved over the floor cover to be cleaned; and said nozzles are disposed proximate the front end of said housing and have their respective longitudinal axes disposed generally parallel to the axis of rotation of said roller.

9. An apparatus as defined in claim 1, wherein said cleaning agent introducing means comprises:

a convergent nozzle, said fluid delivery means operatively associated with the inlet to said convergent nozzle to deliver fluid thereto;

a first aperture providing a means of fluid communication between the throat of said convergent nozzle and said fluid delivery means downstream of the inlet to said convergent nozzle; and a second aperture operatively associated with said first aperture downstream of the throat of said convergent nozzle and operatively associated with a source of cleaning agent.

* * * * *